US005645752A

United States Patent [19]

Weiss et al.

[11] Patent Number: 5,645,752

[45] Date of Patent: Jul. 8, 1997

[54] THIXOTROPIC MAGNETORHEOLOGICAL MATERIALS

[75] Inventors: Keith D. Weiss, Eden Prairie, Minn.; Donald A. Nixon, Wilson, N.C.; J. David Carlson, Cary, N.C.; Anthony J. Margida, Apex, N.C.

[73] Assignee: Lord Corporation, Cary, N.C.

[21] Appl. No.: 575,240

[22] Filed: Dec. 20, 1995

Related U.S. Application Data

[63] Continuation of Ser. No. 355,821, Dec. 14, 1994, abandoned, which is a continuation of Ser. No. 968,655, Oct. 30, 1992, abandoned.

[51] Int. Cl.[6] ..... H01F 1/44

[52] U.S. Cl. ..... 252/62.54; 252/62.52; 252/62.53; 252/62.55; 252/62.56; 252/500; 252/512; 252/513; 252/518; 252/519; 252/520; 252/503; 252/507; 252/508

[58] Field of Search ..... 252/62.52, 62.53, 252/62.54, 62.56, 62.55, 510, 511, 512, 513, 518, 519, 520, 49.6, 304, 313.1, 313.2, 315.2, 315.6, 315.7, 500, 503, 507, 508

[56] References Cited

U.S. PATENT DOCUMENTS

| | | |
|---|---|---|
| Re. 32,573 | 1/1988 | Furumura et al. . |
| 2,575,360 | 11/1951 | Rabinow . |
| 2,661,596 | 12/1953 | Winslow . |
| 2,661,825 | 12/1953 | Winslow . |
| 2,663,809 | 12/1953 | Winslow . |
| 2,667,237 | 1/1954 | Rabinow . |
| 2,670,749 | 3/1954 | Germer . |
| 2,733,792 | 2/1956 | Saxl . |
| 2,751,352 | 6/1956 | Bondi . |
| 2,847,101 | 8/1958 | Bergmann . |
| 2,886,151 | 5/1959 | Winslow . |
| 2,917,480 | 12/1959 | Bailey et al. ..... 252/49.6 |

(List continued on next page.)

FOREIGN PATENT DOCUMENTS

| | | |
|---|---|---|
| 162371 | 10/1952 | Australia . |
| 396237 | 7/1990 | European Pat. Off. . |
| 406692 | 9/1991 | European Pat. Off. . |
| 3534528 | 4/1986 | Germany . |
| 158926 | 6/1978 | Japan . |
| 180240 | 7/1989 | Japan . |
| 5-159917 | 6/1993 | Japan . |

OTHER PUBLICATIONS

Patent Abstracts of Japan—vol. 017, No. 549 (E–1443) Oct. 4, 1993.

Chertkova, G.C, et al., "Influence of Nature of Surfactant on the Electrorheological Effect in Nonaqueous Dispersions," Plenum Publishing Corp., 1982 (Month Unknown).

Kirk–Othmer, *Encyclopedia of Chemical Technology,* John Wiley & Sons, vol. 14:1981, pp. 622–664. (Month Unknown).

Lazareva, T.G., et al., "Effect of an Electric Fild on the Rheological Properties of a Suspension of Titanium Dioxide in Solutions of Cellulose Ethers," Plenum Publishing, 1990 (Month Unknown).

Matsepuro, A. D., "Structure Formation in an Electric Field and the Composition of Electro–rheological Suspensions," Royal Aircraft Establishment Library Translation 2110, Jul. 1993.

Otsubo, Yasufumi, et al., "Electrorheological Behavior of Barium Titanate Suspensions," *Journal of the Soc. of Rheology,* Japan, vol. 18, pp. 111–116, 1990. (Month Unknown).

U. S. Dept. of Commerce, *Technical News Bulletin,* "Magnetic Fluid Clutch," vol. 32, No. 5, pp. 54–60 (May 1948).

Weiss, Keith D., et al., "Viscoelastic Properties of Magneto—and Electro–Rheological Fluids,"1994 International Conference on Intelligent Materials, Jun. 5–8, 1994.

Weiss, Keith D., et al., "High Strength Magneto—and Electro—rheological Fluids," SAE Technical Paper Series No. 932451, SAE International 1993 Congress & Exposition, Sep. 13–15, 1993.

J. Rabinow, "Technical News Bulletin," vol. 32, No. 5, pp. 54–60, issued by U.S. Dept. of Commerce, May, 1948 describing a magnetic fluid clutch.

*Primary Examiner*—Alan D. Diamond
*Attorney, Agent, or Firm*—Wayne W. Rupert

[57] ABSTRACT

A magnetorheological material containing a carrier fluid, a particle component and a thixotropic additive to provide stability against particle settling. The thixotropic additive can be a hydrogen-bonding thixotropic agent, a polymer-modified metal oxide, or a mixture thereof. The utilization of a thixotropic additive creates a thixotropic network which is unusually effective at minimizing particle settling in a magnetorheological material.

39 Claims, No Drawings

U.S. PATENT DOCUMENTS

| | | | |
|---|---|---|---|
| 3,010,471 | 11/1961 | Gross . | |
| 3,047,507 | 4/1962 | Winslow . | |
| 3,207,269 | 9/1965 | Klass . | |
| 3,484,162 | 12/1969 | Clark . | |
| 3,553,708 | 1/1971 | Carreira et al. . | |
| 3,612,630 | 10/1971 | Rosensweig . | |
| 3,700,595 | 10/1972 | Kaiser . | |
| 3,764,540 | 10/1973 | Khalafalla et al. . | |
| 3,784,471 | 1/1974 | Kaiser . | |
| 3,843,540 | 10/1974 | Reimers et al. . | |
| 3,917,538 | 11/1975 | Rosensweig | 252/62.52 |
| 4,121,157 | 10/1978 | Weltman et al. . | |
| 4,356,098 | 10/1982 | Chagnon | 252/62.51 |
| 4,485,024 | 11/1984 | Furumura et al. . | |
| 4,565,940 | 1/1986 | Hubbard . | |
| 4,604,222 | 8/1986 | Borduz et al. . | |
| 4,604,229 | 8/1986 | Raj et al. . | |
| 4,624,797 | 11/1986 | Wakayama et al. . | |
| 4,626,370 | 12/1986 | Wakayama et al. . | |
| 4,645,614 | 2/1987 | Goossens et al. . | |
| 4,687,596 | 8/1987 | Borduz et al. . | |
| 4,701,276 | 10/1987 | Wyman . | |
| 4,702,855 | 10/1987 | Goossens et al. . | |
| 4,732,706 | 3/1988 | Borduz et al. . | |
| 4,733,758 | 3/1988 | Duclos et al. . | |
| 4,741,850 | 5/1988 | Wyman . | |
| 4,749,506 | 6/1988 | Kitahara et al. | 252/62.54 |
| 4,772,407 | 9/1988 | Carlson . | |
| 4,824,587 | 4/1989 | Kwon et al. | 252/62.54 |
| 4,855,079 | 8/1989 | Wyman . | |
| 4,879,056 | 11/1989 | Filisko et al. . | |
| 4,923,057 | 5/1990 | Carlson et al. . | |
| 4,976,883 | 12/1990 | Kanno et al. | 252/62.52 |
| 4,992,190 | 2/1991 | Shtarkman | 252/62.52 |
| 5,007,513 | 4/1991 | Carlson . | |
| 5,013,471 | 5/1991 | Ogawa | 252/62.52 |
| 5,075,021 | 12/1991 | Carlson et al. . | |
| 5,087,382 | 2/1992 | Ishino et al. . | |
| 5,122,292 | 6/1992 | Eusebi et al. . | |
| 5,124,060 | 6/1992 | Yokouchi et al. . | |
| 5,130,040 | 7/1992 | Bloink et al. . | |
| 5,135,672 | 8/1992 | Yabe et al. . | |
| 5,139,691 | 8/1992 | Bloink et al. . | |
| 5,143,637 | 9/1992 | Yokouche et al. | 252/62.52 |
| 5,147,573 | 9/1992 | Chagnon | 252/62.52 |
| 5,167,850 | 12/1992 | Shtarkman . | |
| 5,277,281 | 1/1994 | Carlson et al. . | |
| 5,284,330 | 2/1994 | Carlson et al. . | |
| 5,294,360 | 3/1994 | Carlson et al. . | |
| 5,382,373 | 1/1995 | Carlson et al. | 252/62.55 |
| 5,525,249 | 6/1996 | Kordonsky et al. | 252/62.51 |

THIXOTROPIC MAGNETORHEOLOGICAL MATERIALS

This application is a continuation of application Ser. No. 08/355,821 filed on Dec. 14, 1994, now abandoned, which is a continuation of application Ser. No. 07/968,655 filed on Oct. 30, 1992, now abandoned.

FIELD OF THE INVENTION

The present invention relates to certain fluid materials which exhibit substantial increases in flow resistance when exposed to magnetic fields. More specifically, the present invention relates to magnetorheological materials that utilize a thixotropic network to provide stability against particle settling.

BACKGROUND OF THE INVENTION

Fluid compositions which undergo a change in apparent viscosity in the presence of a magnetic field are referred to as Bingham magnetic fluids or magnetorheological materials. Magnetorheological materials normally are comprised of ferromagnetic or paramagnetic particles, typically greater than 0.1 micrometers in diameter, dispersed within a carrier fluid and in the presence of a magnetic field, the particles become polarized and are thereby organized into chains of particles within the fluid. The chains of particles act to increase the apparent viscosity or flow resistance of the overall fluid and in the absence of a magnetic field, the particles return to an unorganized or free state and the apparent viscosity or flow resistance of the overall material is correspondingly reduced. These Bingham magnetic fluid compositions exhibit controllable behavior similar to that commonly observed for electrorheological materials, which are responsive to an electric field instead of a magnetic field.

Both electrorheological and magnetorheological materials are useful in providing varying damping forces within devices, such as dampers, shock absorbers and elastomeric mounts, as well as in controlling torque and or pressure levels in various clutch, brake and valve devices. Magnetorheological materials inherently offer several advantages over electrorheological materials in these applications. Magnetorheological fluids exhibit higher yield strengths than electrorheological materials and are, therefore, capable of generating greater damping forces. Furthermore, magnetorheological materials are activated by magnetic fields which are easily produced by simple, low voltage electromagnetic coils as compared to the expensive high voltage power supplies required to effectively operate electrorheological materials. A more specific description of the type of devices in which magnetorheological materials can be effectively utilized is provided in copending U.S. patent application Ser. Nos. 07/900,571 and 07/900,567 entitled "Magnetorheological Fluid Dampers" and "Magnetorheological Fluid Devices," respectively, both filed Jun. 18, 1992, the entire contents of which are incorporated herein by reference.

Magnetorheological or Bingham magnetic fluids are distinguishable from colloidal magnetic fluids or ferrofluids. In colloidal magnetic fluids the particles are typically 5 to 10 nanometers in diameter. Upon the application of a magnetic field, a colloidal ferrofluid does not exhibit particle structuring or the development of a resistance to flow. Instead, colloidal magnetic fluids experience a body force on the entire material that is proportional to the magnetic field gradient. This force causes the entire colloidal ferrofluid to be attracted to regions of high magnetic field strength.

Magnetorheological fluids and corresponding devices have been discussed in various patents and publications. For example, U.S. Pat. No. 2,575,360 provides a description of an electromechanically controllable torque-applying device that uses a magnetorheological material to provide a drive connection between two independently rotating components, such as those found in clutches and brakes. A fluid composition satisfactory for this application is stated to consist of 50% by volume of a soft iron dust, commonly referred to as "carbonyl iron powder," dispersed in a suitable liquid medium such as a light lubricating oil.

Another apparatus capable of controlling the slippage between moving parts through the use of magnetic or electric fields is disclosed in U.S. Pat. No. 2,661,825. The space between the moveable parts is filled with a field responsive medium. The development of a magnetic or electric field flux through this medium results in control of resulting slippage. A fluid responsive to the application of a magnetic field is described to contain carbonyl iron powder and light weight mineral oil.

U.S. Pat. No. 2,886,151 describes force transmitting devices, such as clutches and brakes, that utilize a fluid film coupling responsive to either electric or magnetic fields. An example of a magnetic field responsive fluid is disclosed to contain reduced iron oxide powder and a lubricant grade oil having a viscosity of from 2 to 20 centipoises at 25° C.

The construction of valves useful for controlling the flow of magnetorheological fluids is described in U.S. Pat. Nos. 2,670,749 and 3,010,471. The magnetic fluids applicable for utilization in the disclosed valve designs include ferromagnetic, paramagnetic and diamagnetic materials. A specific magnetic fluid composition specified in U.S. Pat. No. 3,010,471 consists of a suspension of carbonyl iron in a light weight hydrocarbon oil. Magnetic fluid mixtures useful in U.S. Pat. No. 2,670,749 are described to consist of a carbonyl iron powder dispersed in either a silicone oil or a chlorinated or fluorinated suspension fluid.

Various magnetorheological material mixtures are disclosed in U.S. Pat. No. 2,667,237. The mixture is defined as a dispersion of small paramagnetic or ferromagnetic particles in either a liquid, coolant, antioxidant gas or a semi-solid grease. A preferred composition for a magnetorheological material consists of iron powder and light machine oil. A specifically preferred magnetic powder is stated to be carbonyl iron powder with an average particle size of 8 micrometers. Other possible carrier components include kerosene, grease, and silicone oil.

U.S. Pat. No. 4,992,190 discloses a rheological material that is responsive to a magnetic field. The composition of this material is disclosed to be magnetizable particles and silica gel dispersed in a liquid carrier vehicle. The magnetizable particles can be powdered magnetite or carbonyl iron powders with insulated reduced carbonyl iron powder, such as that manufactured by GAF Corporation, being specifically preferred. The liquid carrier vehicle is described as having a viscosity in the range of 1 to 1000 centipoises at 100° F. Specific examples of suitable vehicles include Conoco LVT oil, kerosene, light paraffin oil, mineral oil, and silicone oil. A preferred carrier vehicle is silicone oil having a viscosity in the range of about 10 to 1000 centipoise at 100° F.

Many magnetorheological materials such as those described above suffer from excessive gravitational particle settling which can interfere with the magnetorheological activity of the material due to non-uniform particle distribution. One cause of gravitational particle settling in magnetorheological materials is the large difference between the specific gravity of the magnetic particles (e.g., iron=7.86 $gm/cm^3$) and that of the carrier fluid (e.g., silicone oil=0.95 $gm/cm^3$) which can cause rapid particle settling in a magnetorheological material. The metallic soap-type surfactants (e.g., lithium stearate, aluminum distearate) traditionally utilized to guard against particle settling inherently contain significant amounts of water which can limit the useful temperature range of the overall magnetorheological material. The use of a silica gel dispersant as disclosed in U.S. Pat. No. 4,992,190 has presently been found not to significantly minimize particle settling over a prolonged period of time.

A need therefore currently exists for a magnetorheological material that exhibits minimal particle settling for a prolonged period of time and that can be utilized over a broad temperature range.

SUMMARY OF THE INVENTION

The present invention is a magnetorheological material that exhibits minimal particle settling and that can be utilized over a broad temperature range. The present magnetorheological material comprises a carrier fluid, a particle component, and at least one thixotropic additive selected from the group consisting of a hydrogen-bonding thixotropic agent and a polymer-modified metal oxide. It has presently been discovered that a hydrogen-bonding thixotropic agent and a polymer-modified metal oxide can be utilized alone or in combination to create a thixotropic network which is unusually effective at minimizing particle settling in a magnetorheological material.

A thixotropic network is defined as a suspension of colloidal or magnetically active particles that at low shear rates form a loose network or structure, sometimes referred to as a cluster or a flocculate. The presence of this 3-dimensional structure imparts a small degree of rigidity to the magnetorheological material, thereby, reducing particle settling. However, when a shearing force is applied through mild agitation this structure is easily disrupted or dispersed. When the shearing force is removed this loose network is reformed over a period of time. The thixotropic network of the present invention is substantially free of water and effectively prevents particle settling in a magnetorheological material without interfering with the broad temperature capability of that material.

DETAILED DESCRIPTION OF THE INVENTION

The magnetorheological material of the present invention comprises a carrier fluid, a particle component, and at least one thixotropic additive selected from the group consisting of a hydrogen-bonding thixotropic agent and a polymer-modified metal oxide.

The hydrogen-bonding thixotropic agent of the present invention can essentially be any oligomeric compound containing a dipole which can intermolecularly interact with another polar oligomer or particle. These dipoles arise through the asymmetric displacement of electrons along covalent bonds within the polymeric compound. Dipole-dipole interactions are more commonly referred to as hydrogen bonding or bridging. By definition, a hydrogen bond results through the attraction of a hydrogen atom of one molecule (proton donor) to two unshared electrons of another molecule (proton acceptor). A thorough description of hydrogen bonding is provided by L. Pauling and J. Israelachvili in "The Nature of the Chemical Bond" (3rd edition, Cornell University Press, Ithaca, N.Y., 1960) and "Intermolecular and Surface Forces" (Academic Press, New York, 1985), respectively, the entire contents of which are incorporated herein by reference.

In general, an oligomeric compound is described as being a low molecular weight polymer or copolymer consisting of more than two repeating monomer groups or units. An oligomer typically exhibits a molecular weight of less than about 10,000 AMU. Oligomers with a molecular weight between about 1000 and 10,000 AMU are also known as pleinomers. The number of repeating monomeric units in an oligomer is dependent upon the molecular weight of the individual monomeric units. In order for an oligomeric compound to effectively function as a hydrogen-bonding thixotropic agent in the present invention the oligomer should be either a nonviscous or viscous liquid, oil, or fluid. A thorough discussion of the synthesis, characterization and properties of oligomeric compounds is provided by C. Uglea and I. Negulescu in "Synthesis and Characterization of Oligomers," CRC Press, Inc., Boca Raton, Fla., 1991 (the entire content of which is incorporated herein by reference), hereinafter referred to as Uglea.

The hydrogen-bonding thixotropic agent of the present invention can act either as the proton donor or the proton acceptor molecule in the formation of a hydrogen bridge. In order to be effective as a thixotropic agent in the invention the oligomeric compound must contain at least one electronegative atom capable of forming a hydrogen bond with another molecule. This electronegative atom can be contained in the oligomer backbone, in a pendant chain or in the terminating portion of the oligomeric compound. The electronegative atom can be O, N, F or Cl in order to behave as a proton acceptor and can be, for example, present in the form of —O—, =O, —N=, —F, —Cl, $—NO_2$, $—OCH_3$, —C≡N, —OH, $—NH_2$, —NH—, —COOH, $—N(CH_3)_2$ or —NO substituents covalently bound to either a carbon, silicon, phosphorous, or sulfur atom. The electronegative atom within the thixotropic agent for purposes of behaving as a proton donor can be O or N and can be, for example, present in the form of —NH—, —OH, $—NH_2$, and —COOH substituents covalently bound as described above.

Examples of oligomeric compounds which may contain a hydrogen-bonding electronegative atom for purposes of the invention include various silicone oligomers, organic oligomers and organo-silicon oligomers.

The silicone oligomers useful as hydrogen-bonding thixotropic agents in the present invention contain an oligomeric backbone comprised of silicone monomeric units which can be defined as silicon atoms linked directly together or through O, N, S, $CH_2$ or $C_6H_4$ linkages. Silicone oligomers containing these linkages are more commonly referred to as silanes, siloxanes, silazanes, silthianes, silalkylenes, and silarylenes, respectively. The silicone oligomers may contain identical repeating silicone monomeric units (homopolymeric) or may contain different repeating silicone monomeric units as random, alternating, block or graft segments (copolymeric). Due to their broad commercial availability, silicone oligomers containing a siloxane backbone are preferred. It is essential that the siloxane oligomers contain the electronegative hydrogen-bonding substituent either in a pendant chain or as a terminating group to the oligomeric structure since electronegative groups in a siloxane backbone are typically shielded from effectively participating in hydrogen bonding. A thorough description of the synthesis, structure and properties of silicone oligomers is provided by W. Noll in "Chemistry and Technology of Silicones," Academic Press, Inc., New York, 1968

(hereinafter referred to as Noll), and by J. Zeigler and F. Fearon in "Silicon-Based Polymer Science," American Chemical Society, Salem, Mass., 1990 (hereinafter referred to as Zeigler), the entire contents of which are incorporated herein by reference.

The siloxane oligomers of the invention can be represented by the formula:

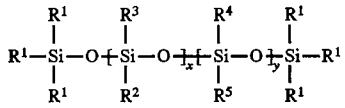

wherein $R^1$, $R^2$, $R^3$, $R^4$, and $R^5$ can independently be a straight chain, branched, cyclic or aromatic hydrocarbon radical, being halogenated or unhalogenated, and having from 1 to about 18, preferably 1 to about 6, carbon atoms; an ester group; an ether group; or a ketone group; with the proviso that at least one of $R^1$, $R^2$, $R^3$, $R^4$, and $R^5$ contains an electronegative substituent being covalently bound to either a carbon, silicon, phosphorous, or sulfur atom. The electronegative substituent is typically present in the form of —O—, =O, —N=, —F, —Cl, —$NO_2$, —$OCH_3$, —C≡N, —OH, —$NH_2$, —NH—, —COOH, —$N(CH_3)_2$ or —NO. The presence of the electronegative substituent is preferably accomplished by at least one of $R^1$, $R^2$, $R^3$, $R^4$, and $R^5$ being a $(CH_2)_wE$ moiety wherein E is selected from the group consisting of CN, $CONH_2$, Cl, F, $CF_3$ and $NH_2$ and w is an integer from 2 to 8. The number of monomeric backbone units as specified by each of x and y can independently vary from 0 to about 150 with the proviso that the sum (x+y) be within the range from about 3 to 300, preferably from about 10 to 150.

Specific examples of siloxane oligomers appropriate to the invention that have an electronegative substituent in the terminating portion of the oligomeric compound include dimethylacetoxy-terminated polydimethylsiloxanes (PDMS), methyldiacetoxy-terminated PDMS, dimethylethoxy-terminated PDMS, aminopropyldimethyl-terminated PDMS, carbinol-terminated PDMS, monocarbinol-terminated PDMS, dimethylchloro-terminated PDMS, dimethylamino-terminated PDMS, dimethylethoxy-terminated PDMS, dimethylmethoxy PDMS, methacryloxypropyl-terminated PDMS, monomethylacryloxypropyl-terminated PDMS, carboxypropyldimethyl-terminated PDMS, chloromethyldimethyl-terminated PDMS, carboxypropyldimethyl-terminated PDMS and silanol-terminated polymethyl-3,3,3-trifluoropropylsiloxanes with aminopropyldimethyl-terminated PDMS, carbinol-terminated PDMS and methacryloxypropyl-terminated PDMS being preferred.

Examples of siloxane oligomers of the invention which have the electronegative substituent in the pendant chain of the oligomeric compound include polycyanopropylmethylsiloxanes, polybis(cyanopropyl) siloxanes, poly(chlorophenethyl)methylsiloxanes, polymethyl-3,3,3-trifluoropropylsiloxanes, polymethyl-3,3,3-trifluoropropyl/dimethylsiloxanes, poly (aminoethylaminopropyl)methyl/dimethylsiloxanes, poly (aminopropyl)methyl/dimethylsiloxanes, poly (acryloxypropyl)methyl/dimethylsiloxanes, poly (methylacryloxypropyl)methyl/dimethylsiloxanes, poly (chloromethylphenethyl)methyl/dimethylsiloxanes, poly (cyanopropyl)methyl/dimethylsiloxanes, poly(cyanopropyl) methyl/methylphenylsiloxanes, polyglycidoxypropylmethyl/dimethylsiloxanes, polymethylphenyl/dimethylsiloxanes, poly (tetrachlorophenyl)/dimethylsiloxanes, polydiphenyl/dimethylsiloxanes, poly(cyanoethyl)methyl/dimethylsiloxanes, and polyethylene oxide/dimethylsiloxanes, with polymethyl-3,3,3-trifluoropropyl/dimethylsiloxanes, poly(cyanopropyl)methyl/dimethylsiloxanes, polymethyl-3,3,3-trifluoropropylsiloxanes, and polycyanopropylmethylsiloxanes being preferred.

The organic oligomers useful as hydrogen-bonding thixotropic agents in the present invention contain an oligomeric backbone comprised entirely of organic monomer units. These monomeric organic units are further described to comprise carbon atoms linked directly together or through oxygen, nitrogen, sulfur or phosphorus linkages. These monomer units may be various ethers, esters, aldehydes, ketones, carboxylic acids, alcohols, amines, amides, haloalkanes and combinations thereof. The organic oligomers of the invention may be either homopolymeric or copolymeric as defined above. A thorough description of the synthesis, structure and properties of organic oligomers and polymers is provided in Uglea and by M. Alger in "Polymer Science Dictionary" (Elsevier Applied Science, New York, 1989), the entire content of which is incorporated herein by reference.

Examples of organic oligomers eligible for use as a hydrogen-bonding thixotropic agent in the invention include polyacetals, polyacetaldehyde, polyacetone, polyacrolein, polyacrylamide, polyacrylate, poly(acrylic acid), polyacrylonitrile, polyacylhydrazone, polyacylsemicarbazide, polyadipamide, polyadipolypiperazine, polyalanine, poly(alkylene carbonate), poly(amic acid), polyamide, poly(amide acid), poly(amide-hydrazide), poly(amide-imide), polyamine, poly(amino acid), polyaminobismaleimide, polyanhydrides, polyarylate, polyarylenesulphone, poly(arylene triazole), poly(aryl ester), poly(aryl ether), polyarylethersulphone, poly(aryl sulphone), polyaspartamide, polyazines, polyazobenzenes, polyazomethines, polyazophenylene, polybenzamide, polybenzil, polybenzimidazole, polybemzimidaloline, polybenzimidazolone, polybenzimidazoquinazolone, polybenzimidazoquinoxaline, polybenzoin, polybenzopyrazine, polybenzothiazole, polybenzoxazindione, polybenzoxazinone, polybenzoxazole, polybismaleimide, polybiurea, polybutylacrylate, polybutylene polyterephthalate, polybutylmethacrylate, polycaprolactone, polycarbazane, polycarbazene, polycarbodiimide, polycarbonate, polycarboxanes, polychloral, polychloroethene, polychloroprene, polychlorostyrene, polychlorotrifluoroethylene, polycyanoterphthalidene, polycyclohexylmethacrylate, polydiethyleneglycol polyadipate, polydimethylketones, polydimethylphenol, polydipeptides, polyepichlorhydrin, polyethersulphone, polyethylacrylate, poly(ethylene adipate), poly(ethylene azelate), poly(ethylene glycol), polyethyleneimine, poly (ethylene oxide), poly(ethyleneoxy benzoate), poly (ethylenesulphonic acid), poly(ethylene terephthalate), polyethylmethacrylate, polyfluoroacrylate, poly(glutamic acid), polyglycine, polyglycolide, poly(hexafluoropropylene oxide), poly(hydroxybenzoic acid), polyhydroxybutyrate, polyhydoxyproline, polyimidazole, polyimidazolone, polyimides, polyethers, polyesters, poly(isobutylvinyl ether), poly(isopropenylmethyl ketone), polylactide, polylaurylmethacrylate, polylysine, polymethacrolein, polymethacrylamide, polymethacrylate, poly(methyacrylic acid), polymethacrylonitrile, polymethylacrylate, poly (methyl-α-alanine), poly(methyl-α-chloroacrylate), poly (methylenediphenylene oxide), poly(γ-methyl-α-L-glutamate), polymethylmethacrylate, poly(methylvinyl ether), poly(methylvinyl ketone), polyoxadiazoles, polyoxamides, polyoxyalkylene sorbitan fatty acid esters, polyoxyalkylene sorbitol esters, polyoxyethylene acids, polyoxyethylene alcohols, polyoxyalkylene glyceride esters, polyoxyalkylene alkyl amines, polyoxyalkylene-alkyl aryl sulfonates, poly(oxyethylene glycol), polyoxymethylene, poly(oxypropylene glycol), poly(oxypropylene polyol), poly(oxytetramethylene glycol), poly(parabanic acid), polypeptides, poly(phenylene ethers), polyphenyleneamine, poly(phenylene oxide), poly(p-phenylenesulphone), poly(-p-phenyleneterephthalamide), poly(phenyl isocyanate), polyphenyloxadiazole, polypivalolactone, polyproline, poly (propylene adipate), poly(propylene azelate), poly (propylene oxide), poly(propylene oxide-b-ethylene oxide), poly(propylene sebacate), polysarcosine, polyserine, polystyrylpyridine, polysulphonamide, polysulponate, polysulphone, polyterephthalamide, polytetrahydrofuran, polytriazole, polytriazoline, polytryosine, polyureas, polyurethanes, poly(vinyl acetate), poly(vinyl acetal), poly (vinyl alcohol), poly(vinylalkyl ethers), polyvinylamine, poly(vinyl chloroacetate), poly(vinyl esters), poly (vinylethyl ether), poly(vinyl formate), poly(vinlyidene chloride), poly(vinylidene cyanide), poly(vinylidene fluoride), poly(vinyl isocyanate), poly(vinyl stearate) and combinations or mixtures thereof with poly(ethylene oxide), poly(hexafluoroproylene oxide), polymethacrylate, poly (propylene oxide), poly(vinyl stearate), polyoxyalkylene sorbitan fatty acid esters, polyoxyalkylene sorbitol esters, polyoxyethylene acids, polyoxyethylene alcohols, polyoxyalkylene glyceride esters, polyoxyalkylene alkyl amines, polyoxyalkylene-alkyl aryl sulfonates and poly(propylene oxide-b-ethylene oxide) being preferred.

The organic oligomers of the invention may also be low molecular weight olefinic copolymers formed by reacting one or more organic monomeric units described above with one or more olefinic monomeric units such as alkene, alkyne or arene monomeric units. Examples of specific olefinic monomeric units include acetylene, alkenamers, alkylenephenylenes, alkylene sulfides, allomers, arylenes, butadiene, butenes, carbathianes, ethylene, styrene, cyclohexadiene, ethylene sulfide, ethylidine, ethynylbenzene, isoprene, methylene, methylenephenylene, norbornene, phenylene, sulphide, propylene sulphide, phenylene sulphide, propylene, piperylene and combinations thereof.

The preferred organic oligomers of the invention are poly(alkylene oxide) oligomers represented by the formula:

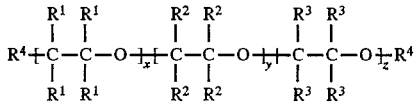

wherein $R^1$, $R^2$ and $R^3$ can independently be hydrogen, fluorine or any straight chain hydrocarbon radical, being halogenated or unhalogenated and having from 1 to about 18, preferably 1 to about 6, carbon atoms, and $R^4$ is either a hydrogen atom or an —OH group. The number of monomeric backbone units as specified by each of x, y and z can independently vary from 0 to about 70 with the proviso that the sum (x+y+z) be within the range from about 3 to 210. Examples of the preferred poly(alkylene oxide) organic oligomers of the present invention can commercially be obtained from BASF Corporation under the trade name PLURONIC and PLURONIC R.

The organo-silicon oligomers useful as hydrogen-bonding thixotropic agents in the present invention are copolymeric and can be block oligomers which contain an oligomeric backbone in which varying size blocks of silicone monomeric units and organic monomeric units are either randomly or alternatingly distributed. The organo-silicon oligomers may also be graft oligomers containing a backbone or chain of silicone monomer units to which are attached organic monomer units. The organic and silicone monomeric units appropriate for preparing the organo-silicon oligomers can be any of the organic and silicone monomeric units described above with respect to the organic and silicone oligomers, respectively. A thorough description of the synthesis, structure and properties of organo-silicon oligomers is provided in Noll and Zeigler.

In general, graft organo-silicon oligomers are the preferred hydrogen-bonding thixotropic agents of the invention. The preferred graft organo-silicon oligomers can be represented by the formula:

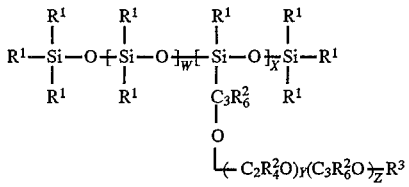

wherein $R^1$ can independently be a straight chain, branched, cyclic or aromatic hydrocarbon radical, being halogenated or unhalogenated, and having from 1 to about 18, preferably from 1 to about 6, carbon atoms; an ester group; an ether group or a ketone group; $R^2$ can independently be hydrogen, fluorine or a straight chain hydrocarbon radical, being halogenated or unhalogenated and having from 1 to about 18, preferably 1 to about 6, carbon atoms, and $R^3$ is an alkyl radical having from 1 to 5 carbon atoms (e.g., ethyl or methyl group) or a hydrogen atom. $R^1$ is preferably a methyl group, $R^2$ is preferably a hydrogen atom, and $R^3$ is preferably a hydrogen atom or methyl group. The number of monomeric silicone backbone units as specified by each of w and x can vary from 0 to about 130 and from 1 to about 40, respectively, with the proviso that the sum (w+x) be within the range from about 3 to 150. The number of monomeric organic units attached to the silicone monomeric units as specified by each of y and z can vary from 0 to about 220 and from 0 to about 165, respectively, with the proviso that the sum (y+z) be within the range from about 3 to 225.

Examples of graft organo-silicon oligomers include alkylene oxide-dimethylsiloxane copolymers, such as ethylene oxide-dimethylsiloxane copolymers and propylene oxide-dimethylsiloxane copolymers; silicone glycol copolymers; and mixtures thereof, with alkylene oxide-dimethylsiloxane copolymers being preferred. Examples of the preferred alkylene oxide-dimethylsiloxane copolymers are commercially available from Union Carbide Chemicals and Plastics Company, Inc. under the trade name SILWET, with SILWET L-7500 being especially preferred.

Several stabilizing agents or dispersants previously disclosed for use in electrorheological materials have also been found to be suitable for use as a hydrogen-bonding thixotropic agent for purposes of the present invention. For example, the amino-functional, hydroxy-functional, acetoxy-functional and alkoxy-functional polysiloxanes disclosed in U.S. Pat. No. 4,645,614 (incorporated herein by reference) may be utilized as a hydrogen-bonding thixotropic agent in the invention. In addition, the graft and block oligomers disclosed in U.S. Pat. No. 4,772,407 (incorporated herein by reference) and also described by D. H. Napper in "Polymeric Stabilization of Colloidal Dispersions," Academic Press, London, 1983, are useful as hydrogen-bonding thixotropic agents as presently defined. Examples of these graft and block oligomers are commercially available from ICI Americas, Inc. under the trade names HYPERMER and SOLSPERSE.

As stated above, the hydrogen-bonding thixotropic agents of the present invention are essentially oligomeric materials that contain at least one electronegative atom capable of forming hydrogen bonds with another molecule. The exemplary hydrogen-bonding thixotropic agents set forth above can be prepared according to methods well known in the art and many of the hydrogen-bonding thixotropic agents are commercially available.

Due to their ability to function over broad temperature ranges, their compatibility with a variety of carrier fluids and the strength of the resulting thixotropic network, the preferred hydrogen-bonding thixotropic agents of the present invention are silicone oligomers and graft and block organo-silicon oligomers with the graft organo-silicon oligomers being especially preferred.

The hydrogen-bonding thixotropic agent is typically utilized in an amount ranging from about 0.1 to 10.0, preferably from about 0.5 to 5.0, percent by volume of the total magnetorheological material.

A colloidal additive may optionally be utilized in combination with the hydrogen-bonding thixotropic agent in order to facilitate the formation of a thixotropic network. The colloidal additives suitable for use in the present invention include any solid, hollow or porous particles that have the ability to interact through hydrogen bonding with the hydrogen-bonding thixotropic agents to form a thixotropic network.

If the thixotropic agent is a proton donor, the colloidal additive must contain an electronegative atom as defined above capable of acting as a proton acceptor. If the thixotropic agent is a proton acceptor, the colloidal additive needs to contain an electronegative substituent capable of acting as a proton donor as defined above.

Examples of colloidal additives useful in the present invention include metal oxide powders that contain surface hydrophilic group functionality. This hydrophillic functionality may be hydroxyl groups or any of the previously described silicone oligomers, organic oligomers, and organo-silicon oligomers covalently bound to the metal oxide. Methods for the attachment of oligomers to the surface of a metal oxide are well known to those skilled in the art of surface chemistry and catalysis. Specific examples of preferred metal oxide powders include precipitated silica, fumed or pyrogenic silica, silica gel, titanium dioxide, and mixtures thereof.

The surface of the metal oxide colloidal additives of the present invention can be made hydrophobic through the partial reaction of the surface hydroxyl groups with various organofunctional monomeric silanes or silane coupling agents, such as hydroxysilanes, acyloxysilanes, epoxysilanes, oximesilanes, alkoxysilanes, chlorosilanes and aminosilanes as is known in the art. A more complete description of the silanes applicable to reacting with the surface hydroxyl groups of the colloidal metal oxide powders is provided in Noll, as well as by E. P. Plueddemann in "Silane Coupling Agents," Plenum Press, New York, N.Y., 1982 (the entire contents of which are incorporated herein by reference). After reacting with the surface of the metal oxide, the silane coupling agents do not possess the ability to form hydrogen bonds. The formation of a thixotropic network with a hydrophobic metal oxide is therefore accomplished through the ability of the hydrogen-bonding thixotropic agent to form hydrogen bonds with the hydroxyl functionality remaining on the metal oxide's surface after modification. The surface-modified hydrophobic colloidal metal oxide additives are, in general, the preferred colloidal additive of the present invention due their ability to be anhydrous without the necessity of going through any additional drying procedure to remove adsorbed moisture.

Specific examples of hydrophobic colloidal metal oxide powders appropriate to the present invention, which are comprised of fumed silicas treated with either dimethyl dichlorosilane, trimethoxyoctylsilane or hexamethyl disilazane, can be commercially obtained under the trade names AEROSIL R972, R974, EPR976, R805, and R812, and CABOSIL TS-530 and TS-610 from Degussa Corporation and Cabot Corporation, respectively.

The colloidal additives of the present invention can also be non-oligomeric, high molecular weight silicone polymers, organic polymers, and organo-silicon polymers comprised of the previously described organic and silicone monomeric units. The high molecular weight silicone, organic and organo-silicon polymers are distinguishable from the oligomers described above due to their much higher molecular weights which are greater than 10,000 AMU. The high molecular weight polymers are typically in the form of a powder, resin or gum when utilized as a colloidal additive.

The present colloidal additives, with the exception of the hydrophobic metal oxide powders, are typically converted to an anhydrous form prior to use by removing adsorbed moisture from the surface of the colloidal additives by techniques known to those skilled in the art, such as heating in a convection oven or in a vacuum. These colloidal additives, as well as the magnetically active particle component described in detail below, are determined to be "anhydrous" when they contain less than 2% adsorbed moisture by weight.

The colloidal additive of the present invention is typically utilized in an amount ranging from about 0.1 to 10.0, preferably from about 0.5 to 5.0, percent by volume of the total magnetorheological material.

A thixotropic network as presently defined may also be created through the use of a polymer-modified metal oxide which may be used alone or in combination with the hydrogen-bonding thixotropic agent defined above. The polymer-modified metal oxides of the present invention are derived from metal oxide powders that contain surface hydroxyl group functionality. These metal oxide powders are the same as described above with respect to the colloidal additives and include precipitated silica, fumed or pyrogenic silica, silica gel, titanium dioxide, and mixtures thereof. The metal oxides of the polymer-modified metal oxides, however, can also be iron oxides such as ferrites and magnetites.

To prepare the present polymer-modified metal oxides, the metal oxide powders are reacted with a polymeric compound compatible with the carder fluid and capable of shielding substantially all of the hydrogen-bonding sites or groups on the surface of the metal oxide from any interaction with other molecules. It is essential that the polymeric compound itself also be void of any free hydrogen-bonding groups. Examples of polymeric compounds useful in forming the present polymer-modified metal oxides include siloxane oligomers, mineral oils, and paraffin oils, with siloxane oligomers being preferred. Siloxane oligomers suitable for preparing polymer-modified metal oxides can be represented by the structure disclosed above with respect to siloxane oligomers useful as hydrogen-bonding thixotropic agents. It is essential that any electronegative substituent-containing group of the siloxane oligomer be covalently bound to the surface of the metal oxide in order to avoid the presence of any free hydrogen-bonding groups. The metal oxide powder may be surface-treated with the polymeric compound through techniques well known to those skilled in the art of surface chemistry. A polymer-modified metal oxide, in the form of fumed silica treated with a siloxane oligomer, can be commercially obtained under the trade names AEROSIL R-202 and CABOSIL TS-720 from Degussa Corporation and Cabot Corporation, respectively.

It is believed that the polymer-modified metal oxides form a thixotropic network through physical or mechanical entanglement of the polymeric chains attached to the surface of the metal oxide. Thus, this system does not function via hydrogen bonding as previously described for the colloidal additives and hydrogen-bonding thixotropic agents. It is believed that this mechanical entanglement mechanism is responsible for the polymer-modified metal oxide's unique ability to effectively form thixotropic networks at elevated temperatures.

The polymer-modified metal oxide is typically utilized in an amount ranging from about 0.1 to 10.0, preferably from about 0.5 to 5.0, percent by volume of the total magnetorheological material.

The diameter of both the colloidal additives and the polymer-modified metal oxides utilized herein can range from about 0.001 to 3.0 μm, preferably from about 0.001 to 1.5 μm with about 0.001 to 0.500 μm being especially preferred.

Carrier fluids that are appropriate for use in the magnetorheological material of the present invention can be any of the vehicles or carrier fluids previously disclosed for use in magnetorheological materials, such as the mineral oils, silicone oils and paraffin oils described in the patents set forth above. Additional carrier fluids appropriate to the present invention include silicone copolymers, white oils, hydraulic oils, chlorinated hydrocarbons, transformer oils, halogenated aromatic liquids, halogenated paraffins, diesters, polyoxyalkylenes, perfluorinated polyethers, fluorinated hydrocarbons, fluorinated silicones, hindered ester compounds, and mixtures or blends thereof. As known to those familiar with such compounds, transformer oils refer to those liquids having characteristic properties of both electrical and thermal insulation. Naturally occurring transformer oils include refined mineral oils that have low viscosity and high chemical stability. Synthetic transformer oils generally comprise chlorinated aromatics (chlorinated biphenyls and trichlorobenzene), which are known collectively as "askarels," silicone oils, and esteric liquids such as dibutyl sebacates.

Additional carrier fluids appropriate for use in the present invention include the silicone copolymers, hindered ester compounds and cyanoalkylsiloxane homopolymers described in co-pending U.S. patent application Ser. No. 07/942,549 filed Sep. 9, 1992, entitled "High Strength, Low Conductivity Electrorheological Materials," the entire disclosure of which is incorporated herein by reference. The carrier fluid of the invention may also be a modified carrier fluid which has been modified by extensive purification or by the formation of a miscible solution with a low conductivity carrier fluid so as to cause the modified carrier fluid to have a conductivity less than about $1\times10^{-7}$ S/m. A detailed description of modified carrier fluids can be found in the U.S. patent application entitled "Modified Electrorheological Materials Having Minimum Conductivity," filed Oct. 16, 1992, by Applicants B. C. Muñoz, S. R. Wasserman, J. D. Carlson, and K. D. Weiss and also assigned to the present assignee, the entire disclosure of which is incorporated herein by reference.

Polysiloxanes and perfluorinated polyethers having a viscosity between about 3 and 200 centipoise at 25° C. are also appropriate for utilization in the magnetorheological material of the present invention. A detailed description of these low viscosity polysiloxanes and perfluorinated polyethers is given in the U.S. patent application entitled "Low Viscosity Magnetorheological Materials," filed concurrently herewith by Applicants K. D. Weiss, J. D. Carlson, and T. G. Duclos, and also assigned to the present assignee, the entire disclosure of which is incorporated herein by reference. The preferred carrier fluids of the present invention include mineral oils, paraffin oils, silicone oils, silicone copolymers and perfluorinated polyethers, with silicone oils and mineral oils being especially preferred.

The carrier fluid of the magnetorheological material of the present invention should have a viscosity at 25° C. that is between about 2 and 1000 centipoise, preferrably between about 3 and 200 centipoise, with between about 5 and 100 centipoise being especially preferred. The carrier fluid of the present invention is typically utilized in an amount ranging from about 40 to 95, preferably from about 55 to 85, percent by volume of the total magnetorheological material.

The particle component of the magnetorheological material of the invention can be comprised of essentially any solid which is known to exhibit magnetorheological acitivity. Typical particle components useful in the present invention are comprised of, for example, paramagnetic, superparamagnetic or ferromagnetic compounds. Specific examples of particle components useful in the present invention include particles comprised of materials such as iron, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. In addition, the particle component can be comprised of any of the known alloys of iron, such as those containing aluminum, silicon, cobalt, nickel, vanadium, molybdenum, chromium, tungsten, manganese and/or copper. The particle component can also be comprised of the specific iron-cobalt and iron-nickel alloys described in the U.S. patent application entitled "Magnetorheological Materials Based on Alloy Particles" filed concurrently herewith by Applicants J. D. Carlson and K. D. Weiss and also assigned to the present assignee, the entire disclosure of which is incorporated herein by reference.

The particle component is typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Various metal powders that are commercially available include straight iron powders, reduced iron powders, insulated reduced iron powders, and cobalt powders. The diameter of the particles utilized herein can range from about 0.1 to 500 μm and preferably range from about 1.0 to 50 μm.

The preferred particles of the present invention are straight iron powders, reduced iron powders, iron oxide powder/straight iron powder mixtures and iron oxide powder/reduced iron powder mixtures. The iron oxide powder/iron powder mixtures are advantageous in that the iron oxide powder, upon mixing with the iron powder, is believed to remove any corrosion products from the surface of the iron powder so as to enhance the magnetorheological activity of the overall material. Iron oxide powder/iron powder mixtures are further described in the U.S. patent application entitled "Magnetorheological Materials Utilizing Surface-Modified Particles," filed concurrently herewith by Applicants K. D. Weiss, J. D. Carlson and D. A. Nixon, and also assigned to the present assignee, the entire disclosure of which is incorporated herein by reference.

The particle component typically comprises from about 5 to 50, preferably about 15 to 40, percent by volume of the total magnetorheological material depending on the desired magnetic activity and viscosity of the overall material.

A surfactant to disperse the particle component may also be optionally utilized in the present invention. Such surfactants include known surfactants or dispersing agents such as ferrous oleate and naphthenate, sulfonates, phosphate esters, stearic acid, glycerol monooleate, sorbitan sesquioleate, stearates, laurates, fatty acids, fatty alcohols, and the other surface active agents discussed in U.S. Pat. No. 3,047,507 (incorporated herein by reference). In addition, the optional surfactant may be comprised of steric stabilizing molecules, including fluoroaliphatic polymeric esters, such as FC-430 (3M Corporation), and titanate, aluminate or zirconate coupling agents, such as KEN-REACT (Kenrich Petrochemicals, Inc.) coupling agents.

The surfactant, if utilized, is preferably a phosphate ester, a fluoroaliphatic polymeric ester, or a coupling agent. The optional surfactant may be employed in an amount ranging from about 0.1 to 20 percent by weight relative to the weight of the particle component.

In order to minimize the presence of water, the magnetorheological material is preferably prepared by drying the particle component and/or the thixotropic additives in a convection oven at a temperature of about 110° C. to about 150° C. for a period of time from about 3 hours to 24 hours. This drying procedure is not necessary for the particle component or the thixotropic additives if they contain less than 2% adsorbed moisture by weight. The drying procedure is also not necessary for the inherently hydrophobic surface-treated colloidal additives or the polymer-modified metal oxides described above. The amount of adsorbed moisture contained within a given powder is determined by weighing the powder before and after the drying procedure.

The magnetorheological materials of the invention may be prepared by initially mixing the ingredients together by hand (low shear) with a spatula or the like and then subsequently more thoroughly mixing (high shear) with a homogenizer, mechanical mixer or shaker, or dispersing with an appropriate milling device such as a ball mill, sand mill, attritor mill, colloid mill, paint mill, or the like, in order to create a more stable suspension.

Evaluation of the mechanical properties and characteristics of the magnetorheological materials of the present invention, as well as other magnetorheological materials, can be obtained through the use of parallel plate and/or concentric cylinder couette rheometry. The theories which provide the basis for these techniques are adequately described by S. Oka in *Rheology, Theory and Applications* (volume 3, F. R. Eirich, ed., Academic Press: New York, 1960) the entire contents of which are incorporated herein by reference. The information that can be obtained from a rheometer includes data relating mechanical shear stress as a function of shear strain rate. For magnetorheological materials, the shear stress versus shear strain rate data can be modeled after a Bingham plastic in order to determine the dynamic yield stress and viscosity. Within the confines of this model the viscosity for the magnetorheological material corresponds to the slope of a linear regression curve fit to the measured data.

In a concentric cylinder cell configuration the magnetorheological material is placed in the annular gap formed between an inner cylinder of radius $R_1$ and an outer cylinder of radius $R_2$, while in a simple parallel plate configuration the material is placed in the planar gap formed between upper and lower plates both with a radius, $R_3$. In these techniques either one of the plates or cylinders is then rotated with an angular velocity $\omega$ while the other plate or cylinder is held motionless. A magnetic field can be applied to these cell configurations across the fluid-filled gap, either radially for the concentric cylinder configuration, or axially for the parallel plate configuration. The relationship between the shear stress and the shear strain rate is then derived from this angular velocity and the torque, T, applied to maintain or resist it.

The evalution of particle settling in formulated magnetorheological materials can be accomplished using standard test methodology known to those skilled in the art of paint manufacturing. An ASTM D869-85 test standard entified "Evaluating the Degree of Settling of Paint" (incorporated herein by reference) discloses an arbitrary number scale in qualitative terms to describe the type of pigment or particle suspension of a shelf-aged sample. The number rating scale by definition utilizes 0 as the lowest value (extremely hard sediment) and 10 as the highest value (perfect suspension) obtainable. This same number scale also can be used to evaluate the particle pigment after attempting to remix (hand stirring with a spatula) the shelf-aged sample to a homogeneous condition suitable for the intended use. An ASTM D1309-88 test standard entitled "Settling Properties of Traffic Paints During Storage" (incorporated herein by reference) discloses a two-week temperature cycling procedure (–21° C. to 71° C.) that accelerates the pigment or particle settling process. This test estimates the amount of particle settling that will occur over a one year time period. Within the confines of this accelerated test, the pigment or particle suspension is evaluated according to the criteria previously defined in ASTM D869-85. In addition to these established ASTM standards, it is possible to obtain supplemental information regarding the amount of particle settling over time by measuring the amount of a clear carrier component layer that has formed above the particle sediment. Since most devices that utilize magnetorheological materials will establish various flow conditions for the material, the ease of remixing the particle suspension of an aged sample under low shear conditions (i.e., several minutes on a paint shaker) provides further information regarding the suitability of the material in various applications.

The following examples are given to illustrate the invention and should not be construed to limit the scope of the invention.

EXAMPLES 1–4

Magnetorheological materials are prepared by adding together a total of 1257.60 g of straight carbonyl iron powder (MICROPOWDER-S-1640, similar to old E1 iron powder notation, GAF Chemical Corporation), a thixotropic additive, an optional colloidal additive, an optional surfactant and 10 centistoke polydimethylsiloxane oil (L-45, Union Carbide Chemicals & Plastics Company, Inc.). In addition to the carbonyl iron powder, Example 3 utilizes 75.00 g Mn/Zn ferrite powder (#73302-0, D. M. Steward Manufacturing Company). The viscosity of the carrier oil is measured at 25° C. by concentric cylinder couette rheometry to be about 16 centipoise. The fluid is made into a homogeneous mixture through the combined use of low shear and high shear dispersion techniques. The components are initially mixed with a spatula and then more thoroughly dispersed with a high speed disperserator equipped with a 16-tooth rotary head. The magnetorheological materials are stored in polyethylene containers until utilized. A summary of the type of additives and the quantity of silicone oil used in Examples 1–4 are provided in Table 1. All of the additives and magnetically active particles utilized in Examples 1–4 contain less than 2% adsorbed moisture by weight. The hydrophilic precipitated silica gel used in Example 4 is dried in a convection oven at 130° C. for a period of 24 hours in order to remove any adsorbed water. All magnetorheological materials are measured by parallel plate rheometry to exhibit a dynamic yield stress in excess of 50 kPa at a magnetic field of about 3000 Oersted.

TABLE 1

| | Type and Quantity (g) of Additives | Weight of Silicone Oil (g) |
|---|---|---|
| Example 1 | 17.25 g hydrophobic fumed silica surface treated with a siloxane oligomer (CABOSIL TS-720, Cabot Corporation) as a polymer-modified metal oxide, 25.15 g polyoxyalkylated alkylaryl phosphate ester (EMPHOS CS-141, Witco Corporation) as a surfactant | 294.73 |
| Example 2 | 25.15 g organomodified polydimethylsiloxane copolymer (SILWET L-7500, Union Carbide Chemicals and Plastics Company, Inc.) as a hydrogen-bonding thixotropic agent, 17.25 g hydrophobic fumed silica surface treated with chlorodimethylsilane (CABOSIL TS-610, Cabot Corporation) as a colloidal additive | 291.49 |
| Example 3 | 26.65 g organomodified polydimethylsiloxane copolymer (SILWET L-7500, Union Carbide Chemicals and Plastics Company, Inc.) as a hydrogen-bonding thixotropic agent | 282.91 |
| Example 4 | 25.15 g organomodified polydimethylsiloxane copolymer (SILWET L-7500, Union Carbide Chemicals and Plastics Company, Inc.) as a hydrogen-bonding thixotropic agent, 17.25 g "dried" hydrophilic precipitated silica gel (HI-SIL 233, PPG Industries) as a colloidal additive | 291.49 |

The degree and type of particle settling that occur in the magnetorheological materials of Examples 1–4 are evaluated. A total of about 30 mL of each magnetorheological material is placed into a glass sample vial of known dimensions. These magnetorheological material samples are allowed to rest undisturbed for a minimum of 30 days. The amount of particle settling is determined after this time period by measuring the volume of clear oil that has formed above the particle sediment. A summary of these test results is provided in Table 2.

The remaining amount of each magnetorheological material is placed into a 1 pint metal can and subjected to the two week temperature cycling procedure defined in ASTM D1309-88. The amount of particle settling that occurs during this accelerated test is equivalent to that expected in a magnetorheological material exposed to ambient conditions over a one year time period. At the end of this time period, the degree of particle sediment and the ease of remixing (by hand with spatula) this sediment is evaluated according to the numerical criteria disclosed in ASTM D869-85, which is described as follows:

| Rating | Description of Material Condition |
|---|---|
| 10 | Perfect suspension. No change from the original condition of the material. |
| 8 | A definite feel of settling and a slight deposit brought up on spatula. No significant resistance to sidewise movement of spatula. |
| 6 | Definite cake of settled pigment. Spatula drops through cake to bottom of container under its own weight. Definite resistance to sidewise motion of spatula. Coherent portions of cake may be removed on spatula. |
| 4 | Spatula does not fall to bottom of container under its own weight. Difficult to move spatula through cake sidewise and slight edgewise resistance. Material can be remixed readily to a homogeneous state. |
| 2 | When spatula has been forced through the settled layer, it is very difficult to move spatula sidewise. Definite edgewise resistant to movement of spatula. Material can be remixed to a homogeneous state. |
| 0 | Very firm cake that cannot be reincorporated with the liquid to form a smooth material by stirring manually. |

In addition, the volume of clear oil that has formed above the particle sediment is determined. Since most devices that utilize these magnetorheological materials will establish various flow conditions for the material, supplemental information regarding the ease of remixing the aged particle sediment is obtained by placing the pint samples on a low shear paint shaker for a period of 3 minutes. The dispersed sediment is then reevaluated according to the rating scale (ASTM D869-85) described above. A summary of the data obtained for this accelerated test is provided in Table 2 along with the data obtained in the 30-day static test described above.

TABLE 2

| | Percentage (%) of Clear Layer to Total Fluid Volume after 30 days | Percentage (%) of Clear Layer to Total Fluid Volume after one year* | Degree of Pigment Suspension (ASTM D869)* | Ease of Remixing Pigment (ASTM D869)* | Ease of Remixing on Paint Shaker (ASTM D869)* |
|---|---|---|---|---|---|
| Example 1 | 9.98 | 33.33 | 4 | 6 | 10 |
| Example 2 | 2.53 | 29.57 | 6 | 7 | 10 |
| Example 3 | 2.36 | 45.17 | 5 | 6 | 10 |
| Example 4 | 6.17 | 19.36 | 2 | 3 | 4 |

*Accelerated to one year by ASTM D1309-88

COMPARATIVE EXAMPLE 5

A comparative magnetorheological material is prepared according to the procedure described in Examples 1–4, but utilizing only 17.25 g "dried" hydrophilic precipitated silica gel (HI-SIL 233, PPG Industries) and 315.88 g of 16 centipoise (25° C.) silicone oil (L-45, 10 centistoke, Union Carbide Chemical & Plastics Company, Inc.). This type of silica gel additive is representative of the preferred dispersant utilized in the magnetorheological material of U.S. Pat. No. 4,992,190. The magnetorheological material exhibits a dynamic yield stress at a magnetic field of 3000 Oersted of about 50 kPa as measured using parallel plate rheometry. The particle settling, degree of suspension, and ease of remixing properties are measured in accordance with the procedures of Examples 1–4. The resulting data is set forth below in Table 3.

TABLE 3

| | Percentage (%) of Clear Layer to Total Fluid Volume after 30 days | Percentage (%) of Clear Layer to Total Fluid Volume after one year* | Degree of Pigment Suspension (ASTM D869)* | Ease of Remixing Pigment (ASTM D869)* | Ease of Remixing on Paint Shaker (ASTM D869)* |
|---|---|---|---|---|---|
| Example 5 | 23.40 | 78.57 | 0 | 0 | 1 |

*Accelerated to one year by ASTM D1309-88

As can be seen from the above examples, the thixotropic additives of the present invention are capable of significantly inhibiting particle settling in a magnetorheological material. In fact, the magnetorheological materials of the invention exhibit unexpectedly minimal particle settling as compared to magnetorheological materials based on traditional dispersants.

What is claimed is:

1. A magnetorheological material comprising:

about 40 to 95 volume percent, based on the total volume of the magnetorheological material, of a carrier fluid;

a paramagnetic, superparamagnetic or ferromagnetic particle component having a particle diameter ranging from about 1.0 to 500 microns;

0.1 to 10 volume percent, based on the total volume of the magnetorheological material, of at least one thixotropic additive selected from the group consisting of a hydrophilic silicone oligomer and a copolymeric organo-silicon oligomer, wherein the organo-silicon oligomer has organic and silicone monomeric units in a block or graft arrangement;

and a colloidal additive, the colloidal additive being a metal oxide powder that contains surface hydroxyl groups wherein the surface of the metal oxide is rendered hydrophobic through the reaction of the surface hydroxyl groups with organofunctional monomeric silanes or silane coupling agents.

2. A magnetorheological material according to claim 1 wherein the hydrophilic silicone oligomer is a siloxane oligomer represented by the formula:

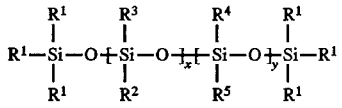

wherein $R^1$, $R^2$, $R^3$, $R^4$, and $R^5$ are independently a straight chain, branched, cyclic or aromatic hydrocarbon radical, being halogenated or unhalogenated, and having from 1 to about 18 carbon atoms; with the proviso that at least one of $R^1$, $R_2$, $R^3$, $R^4$, and $R^5$ contains an electronegative substituent being covalently bound to either a carbon, silicon, phosphorus, or sulfur atom, and being present in the form of —O—, =O, —N=, —F, —Cl, $—NO_2$, $—OCH_3$, —C≡N, —OH, $—NH_2$, —NH—, —COOH, $—N(CH_3)_2$ or —NO; and wherein each of x and y are independently 0 to about 150 with the proviso that the sum (x+y) be within the range from about 3 to 300.

3. A magnetorheological material according to claim 2 wherein the hydrocarbon radical has from 1 to about 6 carbon atoms; at least one of $R^1$, $R^2$, $R^3$, $R^4$, and $R^5$ is a $(CH_2)_wE$ moiety wherein E is selected from the group consisting of CN, $CONH_2$, Cl, F, $CF_3$ and $NH_2$ and w is an integer from 2 to 8; and the sum (x+y) is within the range from about 10 to 150.

4. A magnetorheological material according to claim 1 wherein the hydrophilic silicone oligomer is a siloxane oligomer having an electronegative substituent in the terminating portion of the oligomer and being selected from the group consisting of dimethylacetoxy-terminated polydimethylsiloxanes (PDMS), methyldiacetoxy-terminated PDMS, dimethylethoxy-terminated PDMS, aminopropyldimethyl-terminated PDMS, carbinol-terminated PDMS, monocarbinol-terminated PDMS, dimethylchloro-terminated PDMS, dimethylamino-terminated PDMS, dimethylethoxy-terminated PDMS, dimethylmethoxy PDMS, methacryloxypropyl-terminated PDMS, monomethylacryloxypropyl-terminated PDMS, carboxypropyldimethyl-terminated PDMS, chloromethyldimethyl-terminated PDMS, carboxypropyldimethyl-terminated PDMS and silanol-terminated polymethyl-3,3,3-trifluoropropylsiloxanes.

5. A magnetorheological material according to claim 4 wherein the siloxane oligomer is selected from the group consisting of aminopropyldimethyl-terminated PDMS, carbinol-terminated PDMS and methacryloxypropyl-terminated PDMS.

6. A magnetorheological material according to claim 1 wherein the hydrophilic silicone oligomer is a siloxane oligomer having an electronegative substituent in the pendant chain of the oligomer and being selected from the group consisting of polycyanopropylmethylsiloxanes, poly-bis-(cyanopropyl)siloxanes, poly(chlorophenethyl) methylsiloxanes, polymethyl-3,3,3-trifluoropropylsiloxanes, polymethyl-3,3,3-trifluoropropyl/dimethylsiloxanes, poly(aminoethylaminopropyl)methyl/dimethylsiloxanes, poly(aminopropyl)methyl/dimethylsiloxanes, poly(acryloxypropyl)methyl/dimethylsiloxanes, poly(methylacryloxypropyl)methyl/dimethylsiloxanes, poly(chloromethylphenethyl)methyl/dimethylsiloxanes, poly(cyanopropyl)methyl/dimethylsiloxanes, poly(cyanopropyl)methyl/methylphenylsiloxanes, polyglycidoxypropylmethyl/dimethylsiloxanes, polymethylphenyl/dimethylsiloxanes, poly(tetrachlorophenyl)/dimethylsiloxanes, polydiphenyl/dimethylsiloxanes, poly(cyanoethyl)methyl/dimethylsiloxanes, and polyethylene oxide/dimethylsiloxanes.

7. A magnetorheological material according to claim 6 wherein the siloxane oligomer is selected from the group consisting of polymethyl-3,3,3-trifluoropropyl/dimethylsiloxanes, poly(cyanopropyl)methyl/dimethylsiloxanes, polymethyl-3,3,3-trifluoropropylsiloxanes, and polycyanopropylmethylsiloxanes.

8. A magnetorheological material according to claim 1 wherein the organofunctional monomeric silanes or silane coupling agents are selected from the group consisting of hydroxysilanes, acyloxysilanes, epoxysilanes, oximesilanes, alkoxysilanes, chlorosilanes and aminosilanes.

9. A magnetorheological material according to claim 1 wherein the diameter ranges from about 1.0 to 50 microns.

10. A magnetorheological material according to claim 1 wherein the colloidal additive is fumed silica reacted with dimethyl dichlorosilane, trimethoxyoctylsilane or hexamethyl disilazane.

11. A magnetorheological material according to claim 1 wherein the carrier fluid is selected from the group consisting of mineral oils, silicone oils, paraffin oils, hydraulic oils, transformer oils, halogenated aromatic liquids, halogenated paraffins, diesters, polyoxyalkylenes, and fluorinated silicones.

12. A magnetorheological material according to claim 1 wherein the particle component is comprised of a material selected from the group consisting of iron, iron alloys, iron oxide, iron nitride, iron carbide, carbonyl iron, chromium dioxide, low carbon steel, silicon steel, nickel, cobalt, and mixtures thereof.

13. A magnetorheological material according to claim 1 further comprising a surfactant selected from the group consisting of ferrous oleate and naphthenate, sulfonates, phosphate esters, glycerol monooleate, sorbitan sesquioleate, stearates, laurates, fatty acids, fatty alcohols, fluoroaliphatic polymeric esters, and titanate, aluminate and zirconate coupling agents.

14. A magnetorheological material comprising a carrier fluid, a paramagnetic, superparamagnetic or ferromagnetic particle component having a particle diameter ranging from about 1.0 to 500 microns, and 0.1 to 10 volume percent, based on the total volume of the magnetorheological material, of at least one thixotropic additive comprising a siloxane oligomer selected from the group consisting of polymethyl-3,3,3-trifluoropropyl/dimethylsiloxanes, poly (cyanopropyl)-methyl/dimethylsiloxanes, polymethyl-3,3,3-trifluoropropylsiloxanes, and polycyanopropylmethylsiloxanes.

15. A magnetorheological material comprising 40 to 95 volume percent, based on the total volume of the magnetorheological material, of a carrier fluid, a paramagnetic, superparamagnetic or ferromagnetic particle component having a particle diameter ranging from about 1.0 to 500 microns, and 0.1 to 10 volume percent, based on the total volume of the magnetorheological material, of at least one thixotropic additive comprising a copolymeric organosilicon oligomer having organic and silicone monomeric units in a graft arrangement, and having the formula:

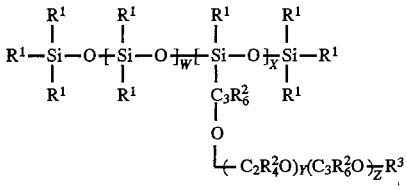

wherein $R^1$ is independently a straight, branched, cyclic or aromatic hydrocarbon radical, being halogenated or unhalogenated, and having from 1 to about 18 carbon atoms; an ester group; an ether group or a ketone group; $R_2$ is independently hydrogen, fluorine or a straight chain hydrocarbon radical, being halogenated or unhalogenated had having from 1 to 18 carbon atoms; $R^3$ is an alkyl radical having from 1 to 5 carbon atoms or a hydrogen atom; the number of monomeric silicone backbone units as specified by each of w and x is from 0 to about 130 and from 1 to about 40, respectively, with the proviso that the sum (w+x) be within the range from about 3 to 150; and the number of monomeric organic units attached to the silicone monomeric units as specified by each of y and z is from 0 to about 220 and from 0 to about 165, respectively, with the proviso that the sum (y+z) be within the range from about 3 to 225.

16. A magnetorheological material according to claim 15 wherein the carrier fluid is selected from the group consisting of mineral oils, silicone oils, paraffin oils, halogenated aromatic liquids, halogenated paraffins, diesters, polyoxyalkylenes, and fluorinated silicone.

17. A magnetorheological material according to claim 16 wherein the carrier fluid is selected from the group consisting of mineral oils and silicone oils.

18. A magnetorheological material according to claim 15 wherein the particle component is comprised of a material selected from the group consisting of iron, iron alloys, iron oxide, iron nitride, iron carbide, carbonyl iron, chromium dioxide, low carbon steel, silicon steel, nickel, cobalt, and mixtures thereof.

19. A magnetorheological material according to claim 15 wherein the particle component is selected from the group consisting of straight iron powders, reduced iron powders, iron oxide powder/straight iron powder mixtures and iron oxide powder/reduced iron powder mixtures.

20. A magnetorheological material according to claim 15 further comprising a surfactant.

21. A magnetorheological material according to claim 20 wherein the surfactant is selected from the group consisting of ferrous oleate and naphthenate, sulfonates, phosphate esters, glycerol monooleate, sorbitan sesquioleate, stearates, laurates, fatty acids, fatty alcohols, fluoroaliphatic polymeric esters, and titanate, aluminate and zirconate coupling agents.

22. A magnetorheological material according to claim 21 wherein the surfactant is a phosphate ester, a fluoroaliphatic polymeric ester, or a titanate, aluminate or zirconate coupling agent.

23. A magnetorheological material according to claim 15 wherein $R^1$ is a methyl group, $R^2$ is a hydrogen atom, and $R^3$ is a hydrogen atom or methyl group.

24. A magnetorheological material comprising a carrier fluid, a paramagnetic, superparamagnetic or ferromagnetic particle component having a particle diameter ranging from about 1.0 to 500 microns, and 0.1 to 10 volume percent, based on the total volume of the magnetorheological material, of at least one thixotropic additive comprising a modified metal oxide prepared by reacting a metal oxide powder with a polymeric compound, a mineral oil or a paraffin oil.

25. A magnetorheological material according to claim 24 wherein the carrier fluid is present in an amount ranging from about 40 to 95 percent by volume, and the particle component is present in an amount ranging from about 5 to 50 percent by volume.

26. A magnetorheological material according to claim 25 wherein the carrier fluid is present in an amount ranging from about 60 to 85 percent by volume, the particle component is present in an amount ranging from about 15 to 40 percent by volume, and the thixotropic additive is present in an amount ranging from about 0.5 to 5 percent by volume of the total magnetorheological material.

27. A magnetorheological material according to claim 24 wherein the metal oxide powder is selected from the group consisting of precipitated silica, fumed or pyrogenic silica, silica gel, titanium dioxide, iron oxides, and mixtures thereof.

28. A magnetorheological material according to claim 24 wherein the polymeric compound is selected from the group consisting of siloxane oligomers, mineral oils, and paraffin oils.

29. A magnetorheological material according to claim 24 wherein the carrier fluid is selected from the group consisting of mineral oils, silicone oils, paraffin oils, hydraulic oils, transformer oils, halogenated aromatic liquids, halogenated paraffins, diesters, polyoxyalkylenes, and fluorinated silicones.

30. A magnetorheological material according to claim 24 wherein the particle component is comprised of a material selected from the group consisting of iron, iron alloys, iron oxide, iron nitride, iron carbide, carbonyl iron, chromium dioxide, low carbon steel, silicon steel, nickel, cobalt, and mixtures thereof.

31. A magnetorheological material according to claim 24 further comprising a surfactant selected from the group consisting of ferrous oleate and naphthenate, sulfonates, phosphate esters, glycerol monooleate, sorbitan sesquioleate, stearates, laurates, fatty acids, fatty alcohols, fluoroaliphatic polymeric esters, and titanate, aluminate and zirconate coupling agents.

32. A magnetorheological material comprising a carrier fluid, a paramagnetic, superparamagnetic or ferromagnetic particle component having a particle diameter ranging from about 1.0 to 500 microns, and 0.1 to 10 volume percent, based on the total volume of the magnetorheological material, of at least one thixotropic additive comprising a polymer-modified metal oxide prepared by reacting a metal oxide powder with a polymeric compound wherein the metal oxide powder is selected from the group consisting of fumed silica, pyrogenic silica and titanium dioxide.

33. A magnetorheological material according to claim 32 wherein the metal oxide powder comprises fumed silica.

34. A magnetorheological material according to claim 32 wherein the polymer-modified metal oxide is fumed silica reacted with a siloxane oligomer.

35. A magnetorheological material according to claim 34 wherein the carrier fluid is selected from the group consisting of mineral oils, silicone oils, halogenated aromatic liquids, halogenated paraffins, diesters, polyoxyalkylenes, and fluorinated silicones.

36. A magnetorheological material according to claim 34 wherein the particle component is comprised of a material selected from the group consisting of iron, iron alloys, iron oxide, iron nitride, iron carbide, carbonyl iron, chromium dioxide, low carbon steel, silicon steel, nickel, cobalt, and mixtures thereof.

37. A magnetorheological material according to claim 34 further comprising a surfactant selected from the group consisting of ferrous oleate and naphthenate, sulfonates, phosphate esters, glycerol monooleate, sorbitan sesquioleate, stearates, laurates, fatty acids, fatty alcohols, fluoroaliphatic polymeric esters, and titanate, aluminate and zirconate coupling agents.

38. A magnetorheological material according to claim 24 wherein the modified metal oxide is hydrophobic.

39. A magnetorheological material according to claim 32 wherein the polymer-modified metal oxide is hydrophobic.

* * * * *